US006866298B2

(12) United States Patent
Molter

(10) Patent No.: US 6,866,298 B2
(45) Date of Patent: Mar. 15, 2005

(54) TOILET VALVE QUICK CONNECT SYSTEM

(76) Inventor: Dan E. Molter, 7704 Ninteenth Ave., Northwest Bradenton, FL (US) 34209

( * ) Notice: Subject to any disclaimer, the term of this patent is extended or adjusted under 35 U.S.C. 154(b) by 0 days.

(21) Appl. No.: 10/215,450

(22) Filed: Aug. 9, 2002

(65) Prior Publication Data

US 2004/0026923 A1 Feb. 12, 2004

(51) Int. Cl.[7] ..... F16L 35/00

(52) U.S. Cl. ..... 285/23; 285/38; 285/390; 285/247; 4/417

(58) Field of Search ..... 285/23, 27, 390, 285/39, 38, 386, 384, 245, 247; 4/417, 418, 419; 411/111, 112, 113

(56) References Cited

U.S. PATENT DOCUMENTS 655,380 A * 8/1900 Stroh ..... 285/38
762,350 A * 6/1904 Rehnstrom ..... 285/386
3,749,356 A * 7/1973 Conley ..... 285/386
6,183,021 B1 * 2/2001 Walsh et al. ..... 285/123.15

* cited by examiner

*Primary Examiner*—David Bochna
(74) *Attorney, Agent, or Firm*—Curtis L. Harrington

(57) ABSTRACT

A toilet valve quick connect includes an upper housing having a capture chamber which facilitates the operation of a capture nut with oversized outward peripheral portions to enable it to be turned within the confines of a typical toilet tank. The toilet valve quick connect has a lower section which extends through the hole in a typical toilet tank and is secured in much the same way as a conventional toilet valve fitting. The toilet valve quick connect includes an internal conical sealing member for facilitating the sealed connection with the bottom rim and inside of a conventional toilet valve fitting. A capture housing partially encloses the capture nut to enable it to engage the threaded bottom fitting of a conventional toilet valve and to impress a downward force on the threaded bottom fitting.

16 Claims, 6 Drawing Sheets

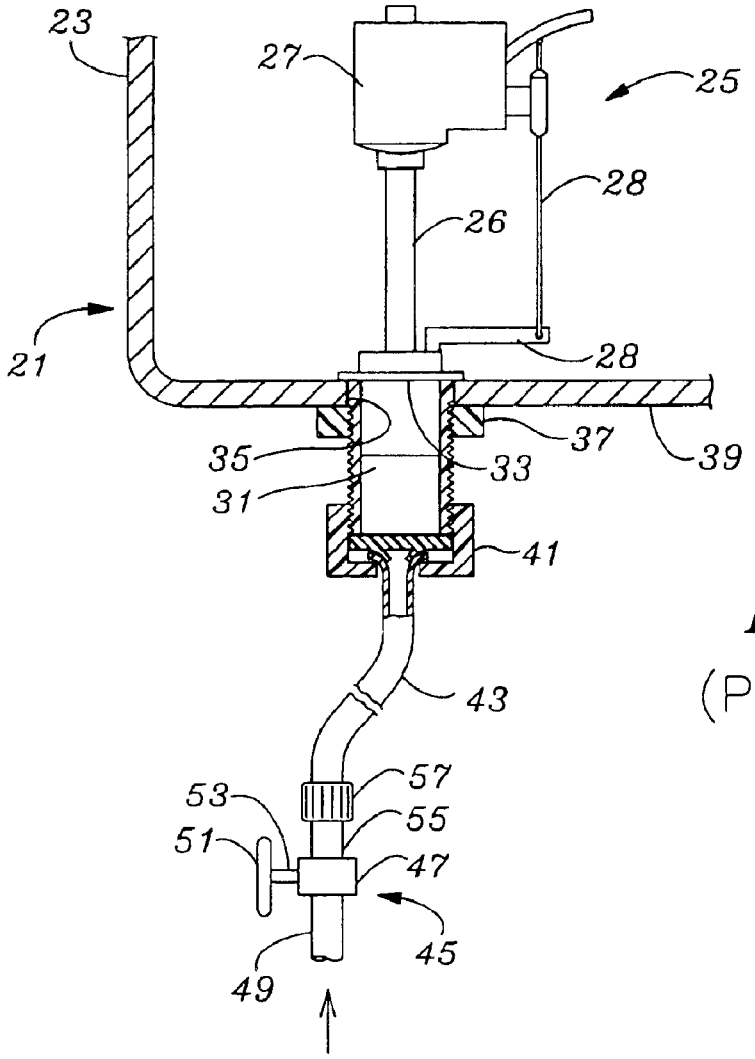
Fig. 1
(PRIOR ART)
Fig. 2
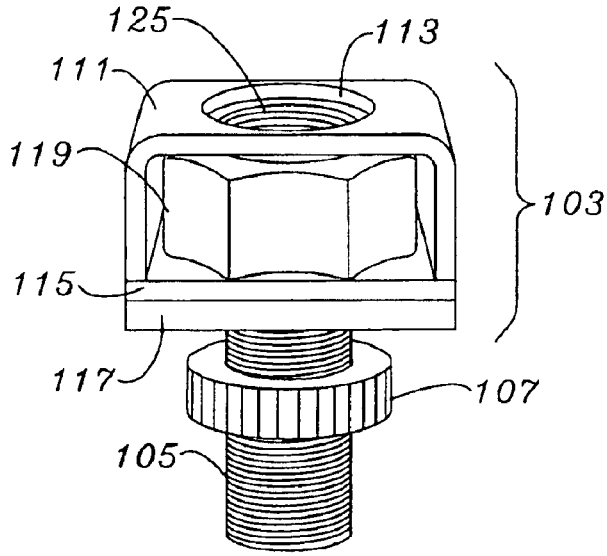

TOILET VALVE QUICK CONNECT SYSTEM

FIELD OF THE INVENTION

The present invention relates to the field of plumbing and bathroom appliances and more particularly to a quick connect and quick disconnect system for conventional flow valves which leaves the water supply fittings in tact and facilitates a quick, non-messy change out of a fill valve.

BACKGROUND OF THE INVENTION

Conventional flush toilets are typically supplied water through a line from a manually available shutoff valve located from 0.5 to 2 feet from the entry of the line into the physical boundary of the toilet tank. The line typically has pressure fittings just above the valve and adjacent the point of connection near the toilet tank.

Pressure fittings are subject to leakage if not properly and precisely "made up". This involves correct fitting, orientation and seating of a flared end of a tube over the fitting followed by correct positioning of a locking nut, with tightening of the locking nut to evenly force the flared end of the tube onto the fitting. Putty or other sealant is typically used upon any connection, either an original connection or a re-connection of an existing line.

Once "made up" or connected, the fitting assemblies can be somewhat sensitive to movement. The fitting assemblies which have been connected the longest are more sensitive to movement, at least partially due to the drying and aging of the sealant. From the water inlet valve typically having a line and fitting assembly a tubular line extends upward to a lower fitting on a conventional toilet fill valve which may be either low profile or conventional float type.

A toilet fill valve is a valve which automatically shuts off to prevent further filling of a toilet tank when the water level reaches a predetermined shut off level. Conventional toilet fill valves, including those which operate by pressure as well as those which operate with a float, typically carry an enlarged threaded member which extends through a hole in the bottom of the tank and which is secured by an external washer. The external washer fixes the orientation and stability of the conventional toilet fill valve.

The orientation and stability fixation must also be accomplished along with enough downward force on the larger threaded through member to securely pull the conventional toilet fill valve sufficiently down to form a seal, with an enlarged portion carrying a seal, against that portion of the inside of the tank surrounding the opening.

Fluid access to the inside of the conventional toilet fill valve is by one of two possible avenues. First, an enlarged nut over fitting can be used to transition the relatively smaller diameter water line to the larger diameter threaded member which extended through the hole in the bottom of the toilet tank. In the alternative, a smaller fitting may be supplied concentrically within the diameter footprint of the conventional toilet fill valve lower fitting as a second fitting for attachment to the other end of the line from the line connected adjacent the shut-off valve with a standard sized nut. In yet other instances, the conventional toilet fill valve may be supplied with an integral line for connection adjacent the shut-off valve. Where an integral line is supplied it may be molded directly into the fitting and simply extend through the larger diameter fitting of the conventional toilet fill valve which then only need be secured with the over fitting nut.

In the first two cases above, the large threaded member is deliberately made of significantly long length to insure that enough linear downward distance is provided to traverse the thickness of the tank at the tank opening, provide enough linear distance to fit the conventional toilet fill valve securing over fitting nut, and still enough left over to accommodate an over fitting nut for securing the inlet water flow line.

As a result, manufacturers of the conventional toilet fill valve assemblies provide much longer than needed downwardly directed fittings. The result of having different types of conventional toilet fill valves with different length lower fittings is that there is a good chance that on replacement that the original water supply line will be either too short or too long for the replacement unit. Where the original water supply line is too short, it must be replaced with a longer one for which care must be taken not to bend the tube to the extent that it kinks. Where the original water supply line is too short, a new longer one must be supplied for which care must be taken not to bend the tube to the extent that it kinks.

In both cases of the conventional toilet fill valve, the step of securing it to the tank followed by securing the line connection from the shut off valve to the conventional toilet fill valve is challenging and time consuming. Where the replacement is of a different type, as for example a conventional toilet fill valve with an integral line being replaced by a conventional toilet fill valve with a fitting, a new line must be re-installed in any event.

Conventional toilet fill valves have assumed a configuration in which the main connection is between the manual water shutoff and the conventional toilet fill valve, with the conventional toilet fill valve secondarily mechanically located through an aperture in the bottom of a toilet tank. The secondary manual connection will often "fight" with the main fluid flow connection.

As a result the user has to worry both about the integrity of a water connection at two points, as well as the physical location of the conventional toilet fill valve by virtue of its position in the tank. Further, the conventional toilet fill valve must seal within the tank, which requires achieving a vertical height necessary to insure adequate sealing. Some seals are larger and softer and require more vertical movement to seal, while others are smaller, require less vertical movement, but may require a stabilization nut of longer axial length (thus occupying more of the downwardly extending fitting). The result of this geometry and system is that it is complicated and tedious to install initially, and complicated, tedious and frustrating to install under replacement conditions.

Under replacement conditions, the same conventional toilet fill valve may not be available. If a conventional toilet fill valve of exact dimension is available, a user will not have to replace the toilet fill supply line by breaking the connections at both the top and the bottom (near the manual shut off valve), but only at the top. However, if the toilet fill supply line is moved by shifting it, the bottom fitting may internally break its seal and have to be broken down, re sealed and made up again. As before, in some cases removal of the conventional toilet fill valve mandates removal of the toilet fill supply line.

Regardless of whether the conventional toilet fill valve has an integral or attached toilet fill supply line, removal of the conventional toilet fill valve from the bottom of the toilet tank necessitates breaking the seal at the access hole. As a result, at least two, and possibly three seals will be broken each time that a conventional toilet fill valve is to be replaced.

Thus, every replacement re-installation of a conventional toilet fill valve risks the integrity of every fluid and mechanical connection above the manual shut-off valve. Further, since a given toilet tank will not be replaced very often, possibly only every twenty or thirty years, and since a conventional toilet fill valve may need replacement every two years or so, the real or potential breakdown of all of the fluid and mechanical connections between the manual cut-off valve and the conventional toilet fill valve makes any replacement work extremely difficult.

What is therefore needed is a system which is enabled to accomplish several valuable objectives during the conventional toilet fill valve replacement operation. First, the risk of integrity of the fluid fittings at the manual cut off, and at the junction between the water supply line and the conventional toilet fill valve lower fitting should be eliminated. Second, the mechanical seal between the fluid lines and fittings extending inside of the tank and the water tank around the entrance hole should not be compromised. Third, the time required to change a defective conventional toilet fill valve should be extremely reduced. Fourth, all of the aforementioned three advantages should be achievable while using a conventional toilet fill valve in order to facilitate a wider number of solutions as well as to avoid an overly complicated customized solution which is incompatible with existing components.

Because the above complexity, the possibility that damage will occur because of movement to the supply channel and in possibly breaking and making up from two to three fluid connections, a plumber is generally necessary for replacing a conventional toilet fill valve. Many attempts at replacing a conventional toilet fill valve result in the necessity for employing a plumber to finish the job even where it was not initially intended to involve a plumber.

SUMMARY OF THE INVENTION

A toilet valve quick connect includes an upper housing having a capture chamber which facilitates the operation of a capture nut with oversized outward peripheral portions to enable it to be turned within the confines of a typical toilet tank. The toilet valve quick connect has a lower section which extends through the hole in a typical toilet tank and is secured in much the same way as a conventional toilet valve fitting. The toilet valve quick connect includes an internal conical sealing member for facilitating the sealed connection with the bottom rim and inside of a conventional toilet valve fitting. A capture housing partially encloses the capture nut to enable it to engage the threaded bottom fitting of a conventional toilet valve and to impress a downward force on the threaded bottom fitting. This enables a quick change of a conventional toilet valve by two simple manipulations of the capture nut.

In the change out, the manual valve is shut off and the toilet is flushed to empty most of the water from the toilet tank, with no refill occurring. The user simply reaches the user's hands down into the tank and turns the capture nut, usually in the counter clockwise direction. This frees the damaged conventional toilet valve upwardly breaking the seal from the internal conical seal and allows easy removal of the damaged conventional toilet valve.

A new conventional toilet valve is entered into the tank with its fitting extending through the capture housing and with the threads of the conventional toilet valve fitting threaded into the capture nut as the capture nut is manually turned. Once the capture nut places a downward axial force on the fitting sufficient to engage the lower end of the fitting onto the sealing member inside the capture housing.

The overall capture housing and fitting assembly has a circumferentially outwardly directed seal member between or on the threaded downwardly extending fitting and a position either on or adjacent the capture housing. The capture housing need only have an over structure to enable the capture nut to impart downward force to the conventional toilet valve fitting engaged by the capture nut. This enables the upper capture housing to have a generally open architecture to enable the capture nut to be removed, inspected, and cleaned at a time mid-point in the replacement process. In the alternative, the capture housing can be configured to more restrictively capture the capture nut. Reasons for a more restrictive capture include the provision of internal friction resistive surfaces and the like. A more restrictive capture should include advantages which overcome possible additional manufacture steps which relate to providing the more restrictive capture, such as additional metal bending or housing attachment or further manufacturing which does not harm the capture nut.

Another embodiment of the invention utilizes a capture assembly which may either be manufactured with or permanently retro-fitted to a toilet tank. Permanent attachment can be achieved by providing a variety of downwardly directed fittings, and may provide for ultrasonic melting or injection of material to form a seal. Regardless of the method of sealing, a permanent seal which can be formed at the factory will be more secure than a user formed seal.

Yet another embodiment, especially to prevent tampering, a compression fitting for a conventional toilet valve fitting can be provided inside a protective container having an elongated compression fitting so that the conventional toilet valve can be replaced by pressing its fitting into a relatively long sealing compression fitting. This configuration eliminates the necessity to have a capture nut to be turned.

Overall, and regardless of the particular system employed, the use of the system herein makes the job of changing conventional toilet flow valves so simple that the necessity for a plumber is eliminated. In larger institutions it will permit general employees to take on the task of toilet valve maintenance to further eliminate the need to summon a plumber for toilet valve change-out, and eliminate the need to summon a plumber for changes and damage to the flow line between the manual shutoff and toilet valve.

BRIEF DESCRIPTION OF THE DRAWINGS

The invention, its configuration, construction, and operation will be best further described in the following detailed description, taken in conjunction with the accompanying drawings in which:

FIG. 1 is a prior art fill valve configuration;

FIG. 2 is a perspective view of a first embodiment of the quick connect assembly of the invention;

DETAILED DESCRIPTION OF THE PREFERRED EMBODIMENT

Figure 3:
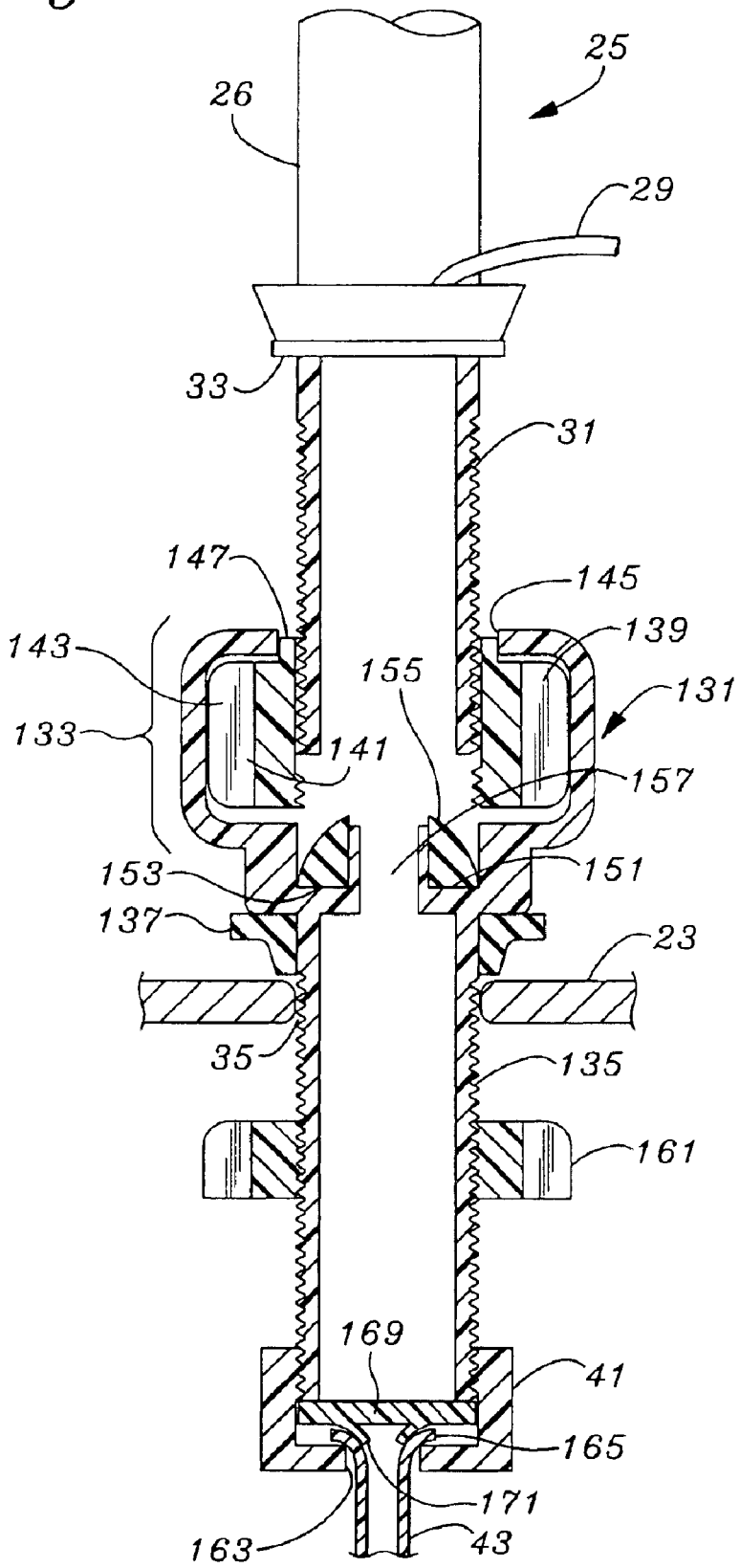
FIG. 3 is a cross sectional view of a second embodiment of the quick connect assembly of the invention.

The description and operation of the invention will be best initiated with reference to FIG. 1 which illustrates a prior art toilet valve and connection system. A conventional mechanical and flow line setup for a typical toilet is seen as conventional system 21. A toilet tank 23 is shown in cross section supporting a conventional toilet valve assembly 25. Conventional toilet valve assembly 25 is meant to represent any type of toilet control and shutoff valve, both conventional and to be designed in future, and both float operated and pressure operated. Conventional toilet valve assembly 25 is also meant to include valves which are controlled by optics, dielectric characteristics and more. A main housing 26 supports a float 27 which can move vertically and which is connected by a link 28 to a flow shutoff lever 29.

Extending below the main housing 26 is a threaded fitting 31. At the junction of the threaded fitting 31 and the housing 26, a sealing member 33 is provided to fit around an opening 35 in the tank 23 provided. The sealing member 33 is positioned such that downward axial pressure on the threaded fitting 31 causes the sealing member 33 to bear more closely against the inside of the tank 23 adjacent the opening 35. This is typically accomplished with a pressure nut 37 which bears directly against an underside 39 of the tank 23 and which transmits a downward force on the threaded fitting 31.

In a typical installation, once the pressure nut 37 is used to secure the conventional toilet valve assembly 25, the next step is the connection of the water flow inlet. In one possible embodiment an oversize fitting nut 41 utilizes the same set of threads of the threaded fitting 31 as did pressure nut 37 to attach a flow line 43 to the fitting 31. The internals of the fitting 31 and the oversize fitting nut 41 can be such as to create a seal by virtue of the pressure of the end of the flow line 43 against sealing surfaces inside the lower end of the fitting 31.

Sealing lubrication can be provided between the flow line 43 and an aperture (not shown) within the oversize fitting nut 41 adjacent the entry of flow line 43 into the oversize fitting nut 41, and between the end of the flow line 43 and sealing surfaces within the fitting 31. The flow line 43 is shown with break lines to illustrate the fact that the location between the bottom surface 39 of a conventional toilet tank 23 and a manual shut-off valve 45 can be of varying closeness.

Shut-off valve 45 has a valve body 47 and an inlet line or fitting 49. A manual knob 51 is connected to a shaft 53 leading into the valve body 47. In a conventional bathroom setting the shut-off valve 45 typically extends a short distance from a wall or floor and is thus essentially supported in a fixed position. As a result, the flow line 43 extends over a fixed distance between a valve fitting 55 and lower fitting 31. A fitting nut 57 is provided for attachment to the valve fitting 55.

Where the distance is short, there is less ability to provide a good fit as the ends of the flow line must be adjusted toward each other in order to be attached. In many cases the flow line 43 may be supplied with the fitting nut 57 and oversize fitting nut 41 supplied, and sold with a flow line 43 of varying length. In other cases, the flow line 43 must be extended through the fitting nut 57 and oversize fitting nut 41 before the ends are flared to both provide a flared sealing surface and to capture the fitting nut 57 and oversize fitting nut 41.

Once the conventional system 21 is "made up" or connected, the fitting assemblies can be somewhat sensitive to movement. In a process of changing out a defective conventional system 21, shut-off valve 45 must be shut, and the toilet tank 23 is flushed to drain it, and then the oversize fitting nut 41 must first be removed, followed by downward disengagement of the upper end of the flow line 43 and its oversize fitting nut 41, and then followed by removal the pressure nut 37 to free the conventional toilet valve assembly 25 to be replaced.

Replacement involves providing a new conventional toilet valve assembly 25 and seating it within opening 35, possibly using sealant) so that the sealing member 33 engages the inside surface of the tank 23 and the opening 35. Pressure nut 37 is attached to fix and seat the conventional toilet valve assembly 25. Then, the oversized fitting nut 41 is brought into contact with the lower end of the fitting 31 with as little bending as possible in flow line 43 to avoid bending or kinking it. After sealant is optionally added, the oversized fitting nut 41 is tightened onto the lower fitting 31.

If movement of the flow line 43 breaks the seal at the valve fitting 55, the fitting nut 57 has to be removed and the flow line 43 removed and re-introduced onto the valve fitting 55. Further, where the length of the downwardly extending fitting 31 differs between the conventional toilet valve assembly 25 being replaced and the conventional toilet valve assembly 25 which replaces it, the flow line 43 may be too long or too short. If too short, the connection from the shut-off valve 45 to the toilet tank 23 and new conventional toilet valve assembly 25 must be made anew, as if it were being installed for the first time.

Referring to FIG. 2, a perspective view of the toilet valve assembly 25 quick connect assembly or quick connect 101 is seen. The quick connect has an upper capture housing 103 and a lower threaded fitting 105. Lower threaded fitting 105 is shown with a pressure nut 107 advanced about midway along its length.

The upper capture housing 103 may advantageously include an attached overcap 111 which includes top and side walls. Overcap 111 has an aperture 113. The attached overcap 111 may be welded to a plate 115. Plate 115 may be welded to a seal support plate 117, or plate 115 may be formed integral to the overcap 111.

Overcap 111 is somewhat box shaped with two open lateral sides. The other two lateral sides have side walls which support a top wall. Overcap 111 with its side walls and top wall are not required to be walls at all, but merely form some sort of restraining cage. The type of restraining cage or even a set of free restraints can be chosen based upon ordinary skill in the art, and dependent upon the types of materials employed.

Especially where metal plates are used, Plates 115 and 117 can combine to provide an internal accommodation space (not shown in FIG. 2) for internal support of an sealing member (also not shown in FIG. 2). One of the plates 115 and 117 could be eliminated where the other was already formed as a complex shape, preferably providing an annular space for an elastomeric seal. This could be accomplished as by providing a single plate with a more deeply machined single plate. In the alternative, the plate 115 and the attached overcap 111 could be formed as a single loop of material having upper aperture 113 and a lower aperture provided by plate 115, with the single loop of material attached to a plate such as the lower plate 117.

An octagonal nut 119 is shown in a lateral capture space 123 formed between the attached overcap 111 and the plate 115. Octagonal nut 119 has a peripheral outer shape for manual engagement by a user, and a threaded internal surface 125 which can be seen through a large opening 113 in the top wall. Each of the octagonal surfaces of the octagonal nut 119, rather than formed of a flat surface, is formed with a curved surface to enable better manual engagement especially in the tight space of the toilet tank 23.

Referring to FIG. 3, a cross sectional area of a second embodiment of a quick connect 131 is seen in an in-service position with respect to a toilet tank 23. From the top, a conventional toilet valve assembly 25, including main housing 26, valve (shut off) lever 29, and threaded fitting 31 is seen with its sealing member 33 falls into disuse because sealing at the threaded fitting 31 occurs at the bottom end and somewhat internally of the threaded fitting 31.

Threaded fitting 31 of conventional toilet valve assembly 25 is shown as relatively tall in FIG. 3, however, the lengths of fitting 31 may vary. In addition, only about one inch of the fitting 31 is necessary in order to be inserted into the paddle nut 139 in order to form a seal. Thus, where clearance is a problem, the lower end of fitting 31 may be cut off. Since the seal 155 predominantly works against the inside of the fitting 31, sealing should be effected even if the cut is not even, so long as any burrs are removed.

A quick connect 131 is seen as having a one piece construction having an upper capture portion 133 positioned above a lower threaded fitting 135. Upper capture portion 133 may be attached to said lower threaded fitting 135 by solvent welding, molecular bonding, fusion welding, or the upper capture portion 133 may be formed at the same time as the lower threaded fitting 135, possibly by the use of a complex mold. A sealing member 137 is located just below the junction of the lower threaded fitting 135 and the upper capture portion 133.

The upper capture portion 133 includes a paddle nut 139 having a central body 141 and a series of extending paddles 143 to facilitate manual actuation of the paddle nut 139. The view of FIG. 3 is one looking into an open side of the upper capture portion 133 and illustrating an opening 145 at the top of the upper capture portion 133. A raised rim 147 may be provided on the paddle nut 139, and which fits partially through the opening 145 to help keep the paddle nut 139 in at least a partial state of capture. The quick connect 131 is shown in a somewhat raised position above the toilet tank 23 boundary as if in a position where vertical sealed engagement is about to take place.

The upper capture portion 133 and internals shown slightly below the paddle nut along the center are formable by machining or molding through the opening 145. An annular accommodation chamber 151 is seen as a sunken annular space which defines a boss 153 about which a sealing member 155 fits.

Annular accommodation chamber 151 is thus an annular depression into the bottom wall of the nut accommodation space of the upper capture portion 195. The sealing member 155 is shown in a slightly "up" position for discussion purposes and to show its surrounding structure, as it typically rests within the annular accommodation chamber 151.

The sealing member 155 is generally conical and by conical meaning that it can have an outward surface which ranges from being conically inwardly swept, conically straight, or conically outward swept, or bullet shaped. The shape generally enables a predominant sealing of the smoother end surfaces of the lower end of the threaded fitting 31 to the inside of the lower end of the threaded fitting 31.

Sealing member 155 can be washer shaped where it is desired to attack the flat sealing end of the inside of the lower end of the threaded fitting 31. Further, such a washer shape could have a groove for fitting both the inside, outside and flat end of the lower end of the threaded fitting 31. The use of the conical sealing member 155 somewhat takes advantage of its conical shape by angular mechanical advantage applied to the portion of the lower end of the threaded fitting 31.

The turning of the paddle nut 139 is accomplished by manipulating the portions of the paddle nut 139 which extend through the lateral openings of the upper capture portion 133, which taken with respect to FIG. 3 are in directions directly facing toward and away from the observer. Since the paddle nut 139 is round, the upper capture portion 133 will need to be somewhat oblong in the direction of the two closed ends seen in FIG. 3 and of somewhat abbreviated length in a direction facing toward and away from the observer of FIG. 3.

The conventional toilet valve assembly 25, once generally positioned within the toilet tank 23, and held in place with one hand can be threaded onto the toilet valve quick connect 131 using the other hand to manipulate the paddle nut 139. Manipulation continues until the threaded fitting 31 of the conventional toilet valve assembly 25 is pulled down onto the sealing member 155 forming a seal with the threaded fitting 31 such that water entering through toilet valve quick connect 131 through an abbreviated bore 157 will flow through the threaded fitting 31 to be controlled by the conventional toilet valve assembly 25.

As can be seen, the toilet valve quick connect 101 or 131 is configured to remain in close connection with the toilet tank 23 on a semi-permanent basis in that toilet valve quick connect 131 can be removed, but it need never be removed in order to replace a conventional toilet valve assembly 25. Further, in instances where the toilet tank 23 is to be replaced, the ability to remove the conventional toilet valve assembly 25 before removing the toilet valve quick connect 101 or 131 makes removal of the latter much easier.

The installation of the toilet valve quick connect 101 or 131 includes the fixation by inserting it through the opening 35 in the toilet tank 23 bottom wall, followed simply by threadably turning a pressure nut seen as a paddle nut 161, which may be the same or different than paddle nut 139, in a direction such that it travels upward on threaded fitting 135. A paddle nut 161 is preferably an abbreviated height paddle nut to accomplish the objectives of having to supply a shorter threaded fitting 135 and to enable a lower underside profile in combination with the nut 41. As is shown, since the toilet valve quick connect assembly 101 or 131 can have the same threaded fitting 105, or 135 as the threaded fitting 31 of the conventional toilet valve assembly 25 in order to use a common internally threaded pressure nut 37, 107 or paddle nut 161 to secure it to the toilet tank 23. This need not be the case, and the threads of the threaded fitting 105 and 135 can have a different size and pitch, especially where it enables a quicker and more secure attachment.

Also seen at the bottom of the lower threaded fitting 135, an internal view of an oversize fitting nut 41 illustrates an opening 163 large enough to admit a section of flow line 43 having a flared end 165, but not large enough that the flared end 165 escape through the opening 163. Opposing the flared end 165 is a sealing plate 169 having an conical boss 171 which faces and seals with the inside surfaces of the flared end 165. The outer periphery of the other side of the sealing plate 169 seals against the bottom open end of the lower threaded fitting 135.

Figure 4:
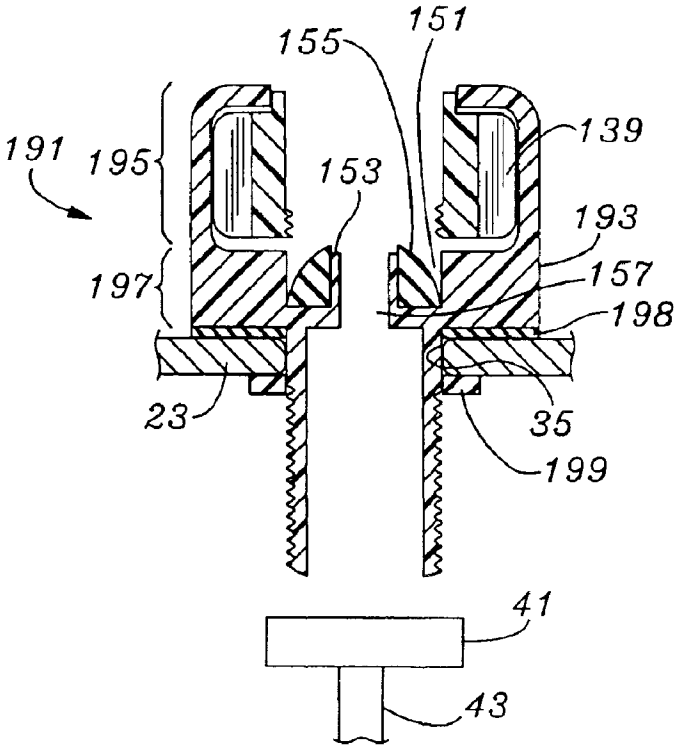
FIG. 4 is a cross sectional view of a third embodiment of the quick connect assembly of the invention likely to be installed within a toilet tank in a factory setting.

In yet another embodiment, and referring to FIG. 4, a third embodiment of a toilet valve quick connect 191 is seen as likely a factory installed structure having a body 193 which includes an upper capture portion 195 containing the capture nut 139, and which has a lower body portion 197 which defines the portion of the toilet valve quick connect 191 which includes the annular accommodation chamber 151, boss 153, sealing member 155 and bore 157 seen in the second embodiment of a toilet valve quick connect 131 of FIG. 3. An optional sealing material 198 is shown and which may be a gasket or a poured elastomeric or other material. Sealing material 198 may also be integral with the body 193 or may be of a gradually differing nature. The main goal is the sealing of the body 193 so that no fluids migrate between the body 193 and the opening 35.

The lower body portion 197 extends through opening 35 of the toilet tank 23 and into a lower flange 199 from which a lower threaded fitting 201 extends. Flange 199 can be formed during manufacture by melting or gluing of material formerly a part of the lower fitting 135. In this configuration, and similar to the other inventive structures, the lower threaded fitting 201 need only be attached to a flow line 43 using a single fitting nut 41. Further, the fitting nut 41 was an over fitting nut and is shown for illustration purposes only. Other fittings can be used, typically the three quarter inch, five sixteenth inch, and other fittings as appropriate. In addition, the third embodiment of a toilet valve quick connect 131 eliminates the axially downward pressure producing members including pressure nut 37, pressure nut 107 or paddle nut 161.

Figure 5:
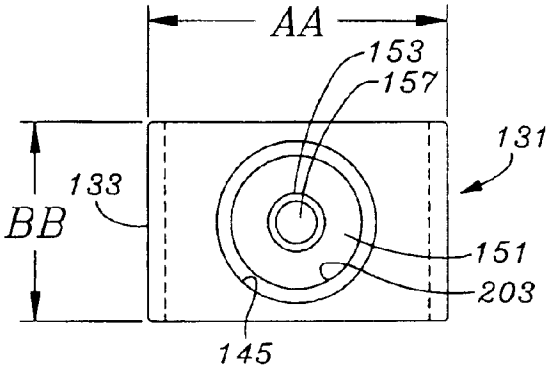
FIG. 5 is a top view of the second embodiment of the toilet valve quick connect seen in FIG. 3 and illustrates the dimensions thereof.

Referring to FIG. 5, a top view of the second embodiment of the toilet valve quick connect 131 gives a more accurate view of the dimensionality of the structure. As stated, the upper capture portion 133 is longer in one direction than the other. The longer dimension AA of the upper capture portion 133 is about 2.124 inches and the shorter dimension BB is about 1.4 inches. The wall thickness of the material of the upper capture portion 133 is about 0.125 inches.

Looking down into the upper capture portion 133 through its upper opening 145 the annular accommodation chamber 151 can be seen to have an outer, inwardly directed wall 203. The diameter of the upper opening 145 is preferably about 1.14 inches while the outer, inwardly directed wall 203 of the annular accommodation chamber 151 has a diameter of about 0.87 inches. The outer diameter of the boss 153 is preferably about 0.41 inches. The internal diameter of the bore 1.57 is preferably about 0.3 inches.

Figure 6:
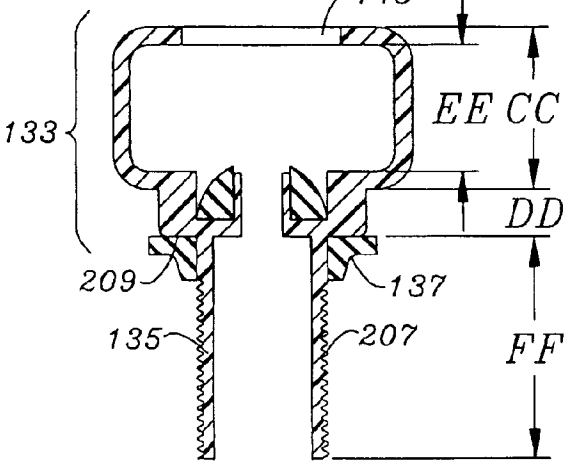
FIG. 6 is a side sectional view of the second embodiment of the valve quick connect seen in FIG. 3 and illustrates the dimensions thereof.

Referring to FIG. 6, a side view of the second embodiment of the toilet valve quick connect 131 gives a more accurate view of the height profile dimensionality of the structure. The upper capture portion 133 has a height CC of about 1.124 inches, leaving the remaining height of the base of the upper capture portion 133 at a dimension DD of about 0.33 inches. The height of the internal capture space for fitting the paddle nut 139 is shown with the dimension EE of about 0.874 inches.

The length of the lower threaded fitting 135 is a dimension FF of about 1.57 inches. The threaded surface 207 is preferably a $^{15}/_{16}\times14$ thread. The threaded surface 207 is shown as ending at an area adjacent the upper capture portion 133, but this need not be the case. However, providing a smooth surface on the lower threaded fitting 135 as well as a smooth lower annular surface 209 on the bottom of the upper capture portion 133 will enable a sealing member 137 to have two smooth surfaces to seal against.

Figure 7:
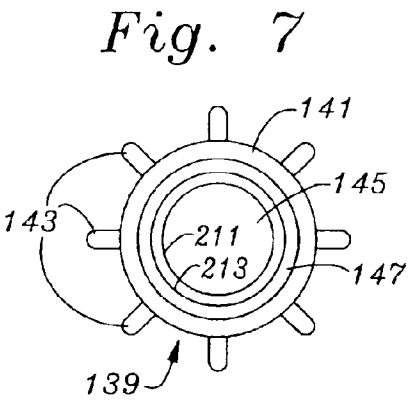
FIG. 7 is a top view of a second embodiment of the actuation nut seen as a paddle nut and illustrates the dimensions thereof.

Referring to FIG. 7, an end view of the paddle nut 139 gives a better illustration of the central body 141 with its series of extending paddles 143. Also seen is the opening 145 surrounded by a threaded surface 211, and having an internal smooth bore section 213. The smooth bore section 213 is not necessary, as the whole of the internal bore of the paddle nut 139 can be threaded. Where the threads are sufficient, providing threads at the bottom portion of the paddle nut 139, especially after a smooth bore section 213 serves two purposes. First, it provides a shorter distance which need be traveled with manual actuation. Second, the smooth bore section 213 provides some auto alignment with the threaded surface 211 by acting as a guide. A longer thread set would require a proportionate increase in assembly time.

Raised rim 147 is also preferably used for enabling both a guided turning and a "snap fit" construction with respect to the inside of the upper capture portion 133. Raised rim 147 has a height which forms an interference against the upper edge of the upper capture portion 133 at its lateral side, upon entry of the paddle nut 139. Upon full insertion, the paddle nut 139 rim fits into the opening 145 with enough tolerance for the raised rim 147 to predominately fit into and reside into opening 145. This position enables the paddle nut 139 to maintain an even fit and turn evenly as the opening 145 "centers" the motion of the paddle nut 139, particularly as the paddle nut 139 is urged upward in reaction to the downward force exerted upon the threaded fitting 31.

Figure 8:
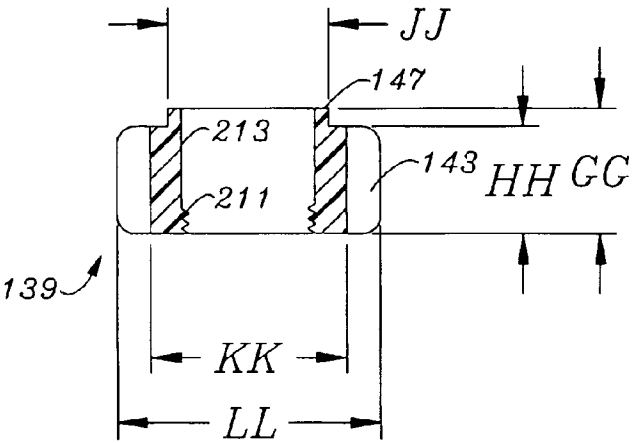
FIG. 8 is a side sectional view of the paddle nut seen in FIG. 7.

Referring to FIG. 8, a side sectional view of the paddle nut 139 is seen, including details discussed with respect to FIG. 7. As can be seen, the paddle nut 139 has an overall height indicated by measurement GG of about 0.8740 inches and a height not including the height of the raised rim 147 indicated by measurement HH of about 0.749 inches, leaving the height of the raised rim 147 to be about 0.125 inches. The threaded surface 211 has a height of about 0.21 inches, with the remainder of the height of the paddle nut 139 internally occupied by the smooth bore section 213.

The diameter of the outwardly disposed face of the raised rim 147, indicated by dimension JJ, is about 1.124 inches. With respect to the inner diameter of the opening 145 of about 1.14 inches, a side turning tolerance of about 0.008 inches. Where the material chosen is polypropylene or polyvinyl chloride, the motion of the paddle nut 139 will be essentially frictionless until vertical force begins to be applied. Under force there will still be low friction.

Other dimensions include the diameter of the hub, indicated by dimension KK of about 1.374 inches, while the maximum reach displacement of the series of extending paddles 143 in opposite directions is indicated by the dimension LL of about 1.85 inches.

Figure 9:
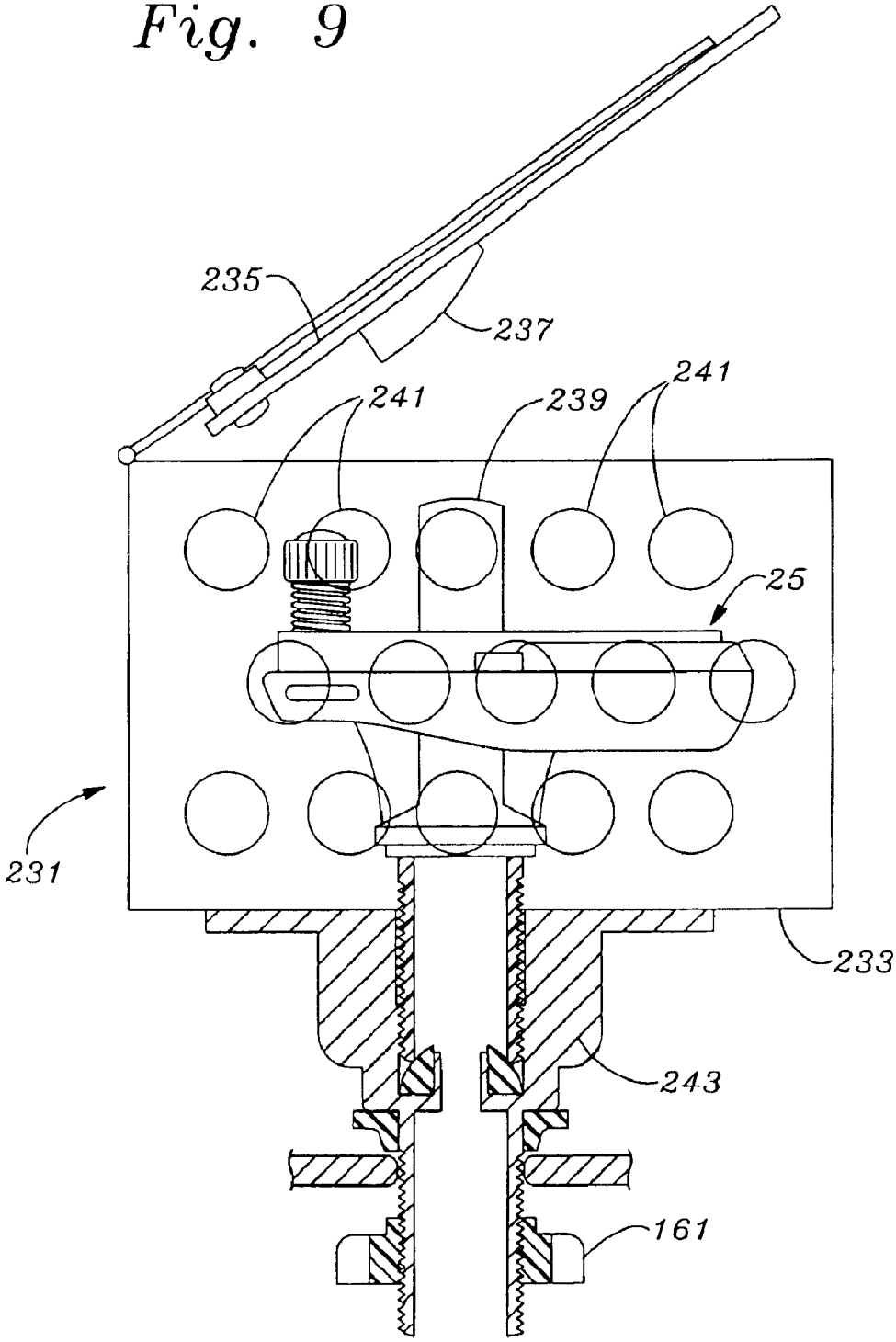
FIG. 9 is a side perspective and semi sectional view of a fourth embodiment as a cartridge or capture system for capturably enclosing a complete conventional toilet flow valve.

Referring to FIG. 9, an over fitting cartridge embodiment is shown as a toilet valve quick connect cartridge system 231. The cartridge type system provides a quick release for any conventional toilet valve 25 based upon capture rather than based upon specialized external structures such as bayonette, fitting hold down, and the like. The use of a capturing system eliminates the need for external structures to be formed integrally into conventional toilet valve 25.

Cartridge system 231 includes the use of a container 233. Container 233 has a lid 235 which may have one or more hold down structures 237 for engaging a compatible structure 239 on any conventional toilet valve 25. The container 233 has a series of apertures 241 which admit water to the inside of the container 233. The Cartridge system 231 container 233 sits atop a base 243.

The use of an enclosed container 233 eliminates two problems encountered with toilet tanks 23 generally. The first is that most toilet tank 23 coverings are not able to be locked down with the type of force and secured engagement which could hold a conventional toilet valve 25 in a sealing engagement. Secondly, most toilet tank 23 coverings cannot be fitted with a structure, especially a variable structure such as hold down structure 237 to complement and engage a conventional toilet valve 25.

Most conventional toilet valves 25 have some upper surface such as compatible structure 239 which lies in opposition to its threaded fitting 31 through which force can be transmitted to create sealing. Other lock down method can be utilized including the following.

In one alternative configuration, a matching half cylinder threaded surface can be provided into which the lower threaded fitting 31 can be laterally fit and then secured with a lateral bearing member. In another, the conventional toilet valve 25 lower threaded fitting 31 can be fitted with a bayonette sleeve to fit in a matching bayonette fitting The base 243, or a structure like it, can be utilized to house a variety of locking mechanisms which operate either mechanically or through the synergistic use of force from the static pressurization available from the water supply. For example, if the base 243 were made of an elastomeric material a grasping center bore could be powered by a pressurized annular bladder.

Figure 10:
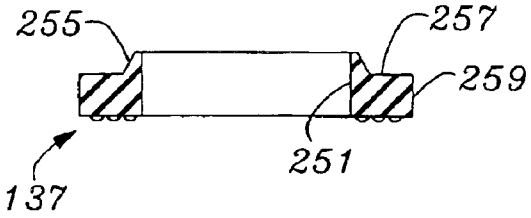
FIG. 10 is a side sectional view of an outer sealing member seen in FIG. 3.

Referring to FIG. 10, a closeup view of the sealing member 137 reveals further details thereof. Sealing member 137 has a central bore 251 having a diameter of about 0.936 inches for fitting over a standard one inch threaded pipe. A short annular section of about 0.03 inch wide horizontal rim surface 253 separates the central bore 251 from an angled surface 255, having an angle of about one hundred twenty degrees from a sealing surface 257 having a width of about 0.195 inches. The overall diameter of sealing member 137 is about 1.5 inches. Sealing member 137 has an outer peripheral surface 259 having a height of about 0.188 inches.

Figure 11:
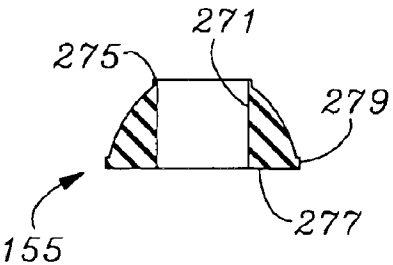
FIG. 11 is a side sectional view of a sealing member seen in FIG. 3 within an upper capture portion of the quick connect assembly of FIG. 3.

Referring to FIG. 11, sealing member 155 details are shown. Sealing member 155 has a central bore 271 having a diameter of about 0.44 inches and a curved exterior surface 273. A rim 275 has a width of about 0.015 inches. At the larger diameter end of sealing member 155, curved exterior surface 273 is separated from an annular end surface 277 by a circumferentially outwardly disposed rim 279 having a width of about 0.05 inches. The radial width of annular end surface 277 has a width of about 0.130 inches. The overall diameter of the sealing member 155 is about 0.87 inches.

Figure 12:
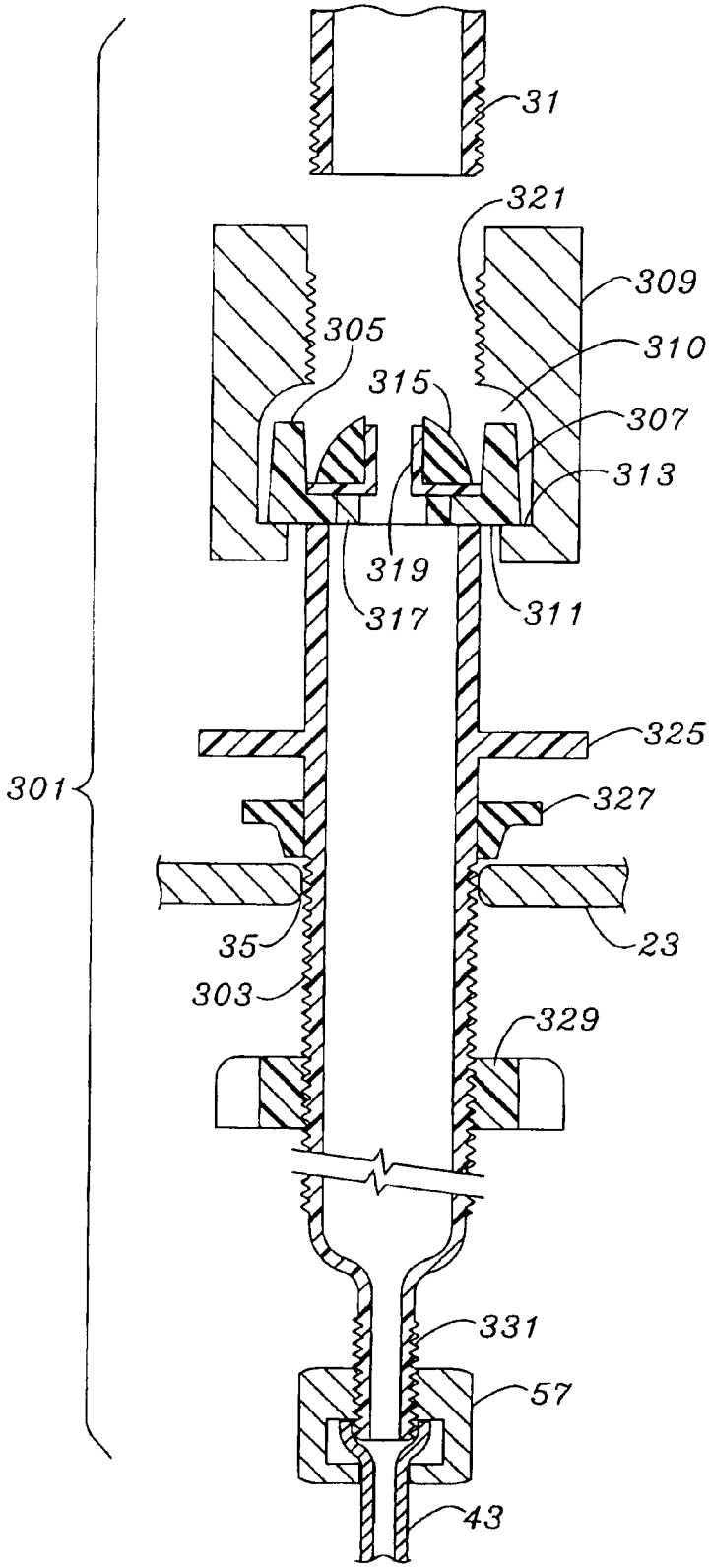
FIG. 12 is a cross sectional view of a fifth embodiment having a simple snap nut above an outwardly disposed flange and which illustrates the possibility of utilizing a standard fitting of the size connected to a standard water cut off valve.

Referring to FIG. 12, an even more simplified embodiment is shown as a quick connect assembly or quick connect 301 which is shown with an option which could be applied to any of the quick connect embodiments 101, 131, and 191, namely enabling a lower termination fitting which generally matches the fitting 55 which was seen in conjunction with the shut-off valve 45.

Quick connect 301 has a generally body 303. Beginning at the upper end, body 303 has an upper rim 305. Adjacent the upper rim 305 and facing circumferentially outward and slightly upward is a tapered rim 307 which is angled outward slightly to enable a nut 309 to be "snap fit" over the upper tapered rim 307 from the top. The "snap fit" urges the rim 307 into an accommodation space 310 within the nut 309. Adjacent the upper tapered rim 307 is a generally downwardly disposed and preferably slightly inwardly disposed bottom surface 311. Surface 311 is complementary to and opposes a ledge surface 313 on the nut 309. Inclining the surfaces 313 and 311 downwardly as they extend away from the body 303 will help form a one-way lock which will be difficult to dislodge.

The clearances and separations are show in an exaggerated manner for illustration purposes, but the actual clearances and relationships will be tighter. For example, tapered rim 307 may not have an even rate of taper. It may have a more concentrically inwardly disposed upper diameter.

A seal 315 may be supported directly by a ledge 317 depending upon the material of choice. An optional support 319 may be employed to bolster the strength of the seal 315 where necessary.

The nut 309 has a threaded surface 321 for engaging the threaded fitting 31. The nut 309 is enabled to slide upwardly and downwardly slightly to enable more ease in engagement with the threaded fitting 31. Below the nut 309, a flange 325 extends to engage a circular seal 327 so that sealing can occur based upon tightening of a nut 329 below the toilet tank 23. This will enable the quick connect 301 to become fixed with respect to toilet tank 23 with change-outs of the conventional toilet valve assembly 25 to occur with no manipulation of the quick connect 301 beyond the manipulation of the nut 309.

Below the stabilization and fixation nut 329 is a standard fitting 331 secured by a fitting nut 57 as seen in FIG. 1. The fitting 331 can be used on any of the the quick connect embodiments 101, 131, 191 and 301 of the invention. Where the fitting is standard, the connection is more secure and the projection profile beyond the bottom of the tank 23 can be reduced.

The body 303 fitting 331 is shown with a broken connection line to show that the fitting 331 is optional. Without the fitting 331, the body 303 is seen to have a simply tubular shape with bilateral symmetry. The quick connect 301 is thus even more easily constructed. The optional shelf 317 can be modified to sit atop upper rim 305 or to have radial projections fitting within matching fingers formed in the upper rim 305.

The quick connect 301 will likely be available assembled and will be loaded into the toilet tank 23 from above and secured by the nut 329. Once the fitting 331 is secured by the fitting nut 57, the conventional toilet valve assembly 25 can be placed inside the toilet tank 23 with its lower fitting extending into the nut 309 to then be secured into a sealed position utilizing seal 315.

While the present invention has been described in terms of a toilet valve quick connect system, the principles contained therein are applicable to other types of sealing and fluid flow systems.

Although the invention is derived with reference to particular illustrative embodiments, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A quick connect system comprising:

a housing having an upper capture portion for enabling a nut to turn and impart downward force with respect to said housing;

a lower externally threaded fitting having an annular shape including a first end having a lower opening and a second end attached to said bottom of said upper capture portion of said housing, at least one of said upper capture portion and said lower externally threaded fitting having a fluid opening, said second end of said lower externally threaded fitting in fluid communication with said fluid opening; and a manually actuatable nut for residing within said nut accommodation space of said upper capture portion for threadably engaging an accommodated threaded fitting inserted into said nut and urging said accommodated threaded fitting toward said lower externally threaded fitting and over said fluid opening.

2. The quick connect system as recited in claim 1 wherein said manually actuatable nut has a rim fitted at least partially within said insertion opening to stabilize the rotation of said manually actuatable nut.

3. The quick connect system as recited in claim 1 wherein said upper capture portion is in the shape of an inclined annular cylinder having a nut accommodation space to enable said nut to be turned within said upper capture portion, and an insertion opening.

4. The quick connect system as recited in claim 1 wherein said housing upper capture portion is in the shape of a box laterally open on two opposing sides and defining a nut accommodation space, said box having a top wall having an insertion opening, a pair of side walls having first sides connected to said top wall and second sides connected to a bottom wall, said bottom wall having a fluid flow opening.

5. The quick connect system as recited in claim 4 wherein said manually actuatable nut has a rim, and wherein a clearance between said top wall and said bottom wall enables said manually actuatable nut with said rim to have a snap fit capture of said rim within said insertion opening.

6. The quick connect system as recited in claim 4 wherein said bottom wall of said upper capture portion is at least one of integral with and formed by said second end of said lower externally threaded fitting.

7. The quick connect system as recited in claim 4 wherein said bottom wall of said upper capture portion includes a depression for accommodating a sealing member.

8. The quick connect system as recited in claim 4 and further comprising a sealing member having an aperture in fluid communication with said fluid flow opening.

9. The quick connect system as recited in claim 8 wherein said sealing member is at least one of bullet and conical shaped.

10. The quick connect system as recited in claim 1 wherein said manually actuatable nut is a paddle nut having projections for facilitating manual engagement of said paddle nut.

11. The quick connect system as recited in claim 1 and further comprising a pressure nut for engaging said lower externally threaded fitting for fixing said quick connect system with respect to a toilet tank.

12. The quick connect system as recited in claim 1 and further comprising a sealing member surrounding said lower externally threaded fitting adjacent said upper capture portion of said body.

13. The quick connect system as recited in claim 1 wherein said housing, including said an upper capture portion and said lower externally threaded fitting is integrally formed of one piece construction.

14. The quick connect system as recited in claim 1 wherein said manually actuatable nut has an internal bore having an axial length and wherein less than half of said axial length is threaded.

15. A quick connect system comprising:

a housing having an upper capture portion having a nut accommodation space and having an upmost portion which is at least partially open and having a lower portion within said accommodation space having a fluid flow opening;

a lower externally threaded fitting having an annular shape connected to said upper capture portion including a first end having a lower opening and a second end adjacent said lower portion of said upper capture portion;

a flange connected to said lower externally threaded fitting for holding said upper capture portion adjacent a toilet tank wall; and a manually actuatable nut for residing within said nut accommodation space of said upper capture portion for threadably engaging an accommodated threaded fitting inserted through said insertion opening and urging said accommodated threaded fitting toward said lower externally threaded fitting.

16. The quick connect system as recited in claim 15 and further comprising a sealing member adjacent said flange and wherein said flange is for placing downward pressure on said sealing member.

* * * * *